US005195869A

United States Patent [19]

Groenhoff

[11] Patent Number: 5,195,869

[45] Date of Patent: Mar. 23, 1993

[54] WINDOW FRAME ADAPTER FOR PORTABLE BOX FANS

[76] Inventor: Larry C. Groenhoff, 816 W. 10th St., Loveland, Colo. 80537

[21] Appl. No.: 931,609

[22] Filed: Aug. 18, 1992

[51] Int. Cl.[5] ..... F01D 25/26

[52] U.S. Cl. ..... 415/213.1; 416/244 R; 248/208; 454/207

[58] Field of Search ..... 416/244 R, 246; 417/234; 248/205.2, 208, 236; 415/213.1; 454/207

[56] References Cited

U.S. PATENT DOCUMENTS

| | | | |
|---|---|---|---|
| 1,741,504 | 12/1929 | Dalton | 248/208 |
| 1,954,419 | 4/1934 | Lynch et al. | 248/208 |
| 2,316,704 | 4/1943 | Moore | 248/208 |
| 2,448,671 | 9/1948 | Hord | 248/408 |
| 2,529,040 | 11/1950 | Morrison | 454/208 |
| 2,715,495 | 8/1955 | Bastian | 416/246 |
| 2,818,793 | 1/1958 | Hord | 248/208 |
| 2,945,358 | 7/1960 | MacLeod et al. | 248/208 |
| 2,946,274 | 7/1960 | Grimes, Jr. | 248/236 |
| 5,050,831 | 9/1991 | Joyal | 248/208 |

OTHER PUBLICATIONS

Lasko Metal Products 1992 Fan Catalog—Window Fans and Portable Box Fans.

Lakewood Metal Products 1992 Fan Catalog—Portable Box Fans.

Toastmaster Inc. 1991 Fan Catalog—Portable Box Fans.

*Primary Examiner*—Thomas E. Denion

*Attorney, Agent, or Firm*—Dean P. Edmundson

[57] ABSTRACT

An adjustable adapter, which permits any portable box fan to be operated while sitting on any household windowsill. Many home or apartment windowsills are too narrow (front to back) for the box fan to stand alone. The adapter provides the needed support, even on sills as narrow as 2" or with windows that do not have a vertical sliding sash for support. An adapter assembly (32) consists of a flat rigid base member (12) which is directly connected to the enclosure of a box fan (14) with hook and loop fasteners (10 and 10A). A protruding arm (16) is connected at one end to base member (12). A contact finger (24) on the opposite end of arm (16) is placed into a window frame track (28) to support box fan (14). A secondary protruding arm (16A) is used to retain a window curtain (38) out of the air intake. This is done by placing curtain (38) between arm (16) and arm (16A). Secondary arm (16A) is also used to instantly support fan (14) when fan (14) is rotated 180° on windowsill (30). One of the two elastic bands (20) or (20A) is used to tie curtain (38) to adapter assembly (32).

6 Claims, 1 Drawing Sheet

WINDOW FRAME ADAPTER FOR PORTABLE BOX FANS

BACKGROUND

1. Field of Invention

This invention relates to accessories for common 20" box fans, specifically to devices which permit window mounting and operation of such fans, alternatively referred to as portable suitcase fans.

2. Description of Prior Art

Typical box fan usage demonstrates need for the invention, and indicates the high efficiency of window mounted fans. Manufacturers information will be cited. Portable 20" box fans have been extremely popular for at least forty-six years. These large, economical fans are lightweight and capable of moving a lot of air. Innovations to improve the versatility and efficiency of these fans have been limited.

Many home or apartment windowsills are too narrow (front to back) to support a box fan. The fan will simply fall over to the floor. Most box fan feet are spaced from 5.5" to 6.75" apart. Nearly all sills on "horizontal" type sliding windows are too narrow. The (flat) surface is usually less than 4.5" wide. This type of window is predominant in western U.S. homes (especially apartments). They have been popular since the 1950's. Even on wider windowsills the fan may fall to the floor during outdoor wind reversal, so extra security can still be desirable. Most types and sizes of "vertical" sliding sashes can be closed on the fan top regardless of sill width. The fan speed control knob or handle must be leaned against one side of the window sash for reliable support. The fan overhangs into the space under the sash, between the sash track and window screen to permit such use. This is not possible with a "horizontal" sliding sash window, since the sash track and screen are side by side. The sash track and screen track are usually an integral aluminum unit which is raised from the sill surface.

Most portable box fans are operated at night or when outdoor air is cooling. Normally, all the house windows are opened. If the windows will not accommodate the box fan, it is placed on a table, chair, dresser or anything available near a window. This is done to try and exhaust the hot air, and draw in cool air through the other windows. Window placement is especially crucial if there is little wind outdoors. Any large fan sitting in front of a screen door is in the way. This position is usually close enough to the television to be a noise problem. Placing the box fan anywhere except right in a window or other opening does little more than circulate indoor air within one room. Some type of oscillating fan is normally used for this purpose.

Fan capacity specifications from different manufacturers vary greatly, but generally a conventional 20" "window fan" with an extra high speed motor is recommended to ventilate an entire "average" size, two story house. A 20" "window fan" with a standard motor is recommended for an entire single floor. Average cost of this cheeper version is still four to five times the 20" box fan price. U.S. Pat. No. 2,715,495 to Bastian (1950) discloses the basic type of "window fan" mounting. Conventional "window fans" are designed for seasonal, semi-permanent installation, and cannot be readily moved to other windows. These "window fans" are made to be installed only in "vertical" type sliding windows of limited width, 36" to 41" max./27" min. wall-to-wall. Sliding panels on each side of the fan are moved into the window frame track or attached by wood screws to the frame surface. Then, four special screws in the fan housing are tightened to lock the panels in place and support the fan. 20" "window fans" cannot be used in "horizontal" sliding windows since the open half is on one side, therefore, only one fan panel can be extended and will not reach the opposite side wall. The frame track on this type of window cannot be used, since the standard opening is only 21" wide. A conventional "window fan" that will work in "horizontal" type window openings requires such a small inefficient fan size that it defeats the "whole house" ventilating capability.

"Attic fans" are the most effective at removing hot air. They are very expensive and require major ceiling construction work.

"Pedestal fans" work poorly for "whole house" use. They are top heavy, requiring a broad base, which prevents effectively close placement to a window. The largest diameter commonly available is a substantial 18", but the tall pedestal and 38" wide base make it cumbersome to move. Carrying this fan through bedroom doorways and placing it around furniture is a problem. An 18" unit costs about five times more than a 20" box fan.

A four leg, two wheel stand is available for 20" box fans. The combination is awkward to move since the legs are made widely spaced for stability. Getting around furniture is a problem. This combination usually cannot be placed close enough to windows to provide much coupling with outdoor air. The stand costs as much as the box fan itself.

Heretofore most prior art related only to air conditioners and conventional "window fan." If their mounting features were incorporated into a portable box fan, the result would approximate a conventional "window fan" in terms of high cost, inconvenience and limited versatility for use with different window types. New design methods would not benefit box fans that are already in use.

Heretofore the only adapter specially designed for portable box fans was U.S. Pat. No. 5,050,831 to Joyal (1991) disclosing an adapter that is limited to using the fans carrying handle together with a "vertical" sliding window sash. The preceding discussion, on page one of this present specification indicates why an adapter is usually not necessary (though helpful) with "vertical" sliding sash windows. In light of this notation the Joyal disclosure is of moderate value. This restrictive adapter is also rather inconvenient to use. It must be removed from the fan handle to reverse or carry the fan to another window. The window "sash" must be adjusted each time the fan is installed, removed or reversed. The more complex, two piece "adjustable" embodiment would likely be as expensive to manufacture as the box fan itself. The telescoping sash post used for "ventilation adjustment" is generally not needed since virtually all box fans have selectable motor speeds.

U.S. Pat. No. 2,529,040 to Morrison (1950) discloses a semi-permanent type "window fan." Morrison uses common hardware store turnbuckles to tighten his fan against rubber pads located on both sides of a "vertical" sliding window. If the end user of a portable box fan employed turnbuckles for support, he would have to modify and damage the window frame and fan.

The instructions supplied with all box fans specifically warn consumers not to use the fan where curtains may be drawn into the air intake. This may cause motor overheating with possible fire hazard. It should be noted that the use of turnbuckles does not solve this problem. It is often possible to position a standard portable box fan near the face of some window frame types. The small space between the turnbuckle and fan could possibly be used to retain a small, thin curtain made of lace, but could not be used with more common curtains. Such use, even with small lace curtains, would be inconvenient and awkward. The box fan carrying handle encloses a similar size space and is therefore equally impractical for such use.

BRIEF SUMMARY

Objects and advantages of the present invention are:

(a) to permit "universal" operation of low cost portable box type fans on household windowsills. This includes "horizontal" sliding windows with sills as narrow as 2", and "vertical" sliding types (double and single hung). Heretofore all large "window fans" and box fan adapters were limited to use with only vertical sliding type windows.

(b) to provide a window adapter which essentially becomes part of the fan "unit" so it can be left in place during fan installation, removal, reversal or floor use.

(c) to permit quick, single handed fan placement to another window as outdoor air flow, or personal use requires. The noisy fan can be moved to any room, away from sleeping people or T.V., etc.

(d) to permit instant 180° reversal of the box fan, so it can blow in or out of the house. In most cases, no readjustment of the adapter position is required. Portable box fans are not electrically reversible.

(e) to provide easily adjustable, yet stable, support. This has been accomplished by using a large area of hook and loop fastener connected directly to the fan enclosure. Operable position of the fan can be adjusted to vertical with any window or box fan combination used.

(f) to eliminate the need for destructive and time consuming window frame, windowsill or fan modifications.

(g) to save room space by avoiding the need to set the fan on furniture or use a stand.

(h) to permit open curtains to be easily retained out of the air flow. No separate bungee cords, clothespins or other inconveniences are required. Most curtains can even be closed and adequately retained after placing them across the box fan top and between the adapter arms.

(i) to provide incentive for using an energy saving device through very low cost, true convenience and versatility.

BRIEF DESCRIPTION OF THE DRAWING FIGURES

Figure 3:
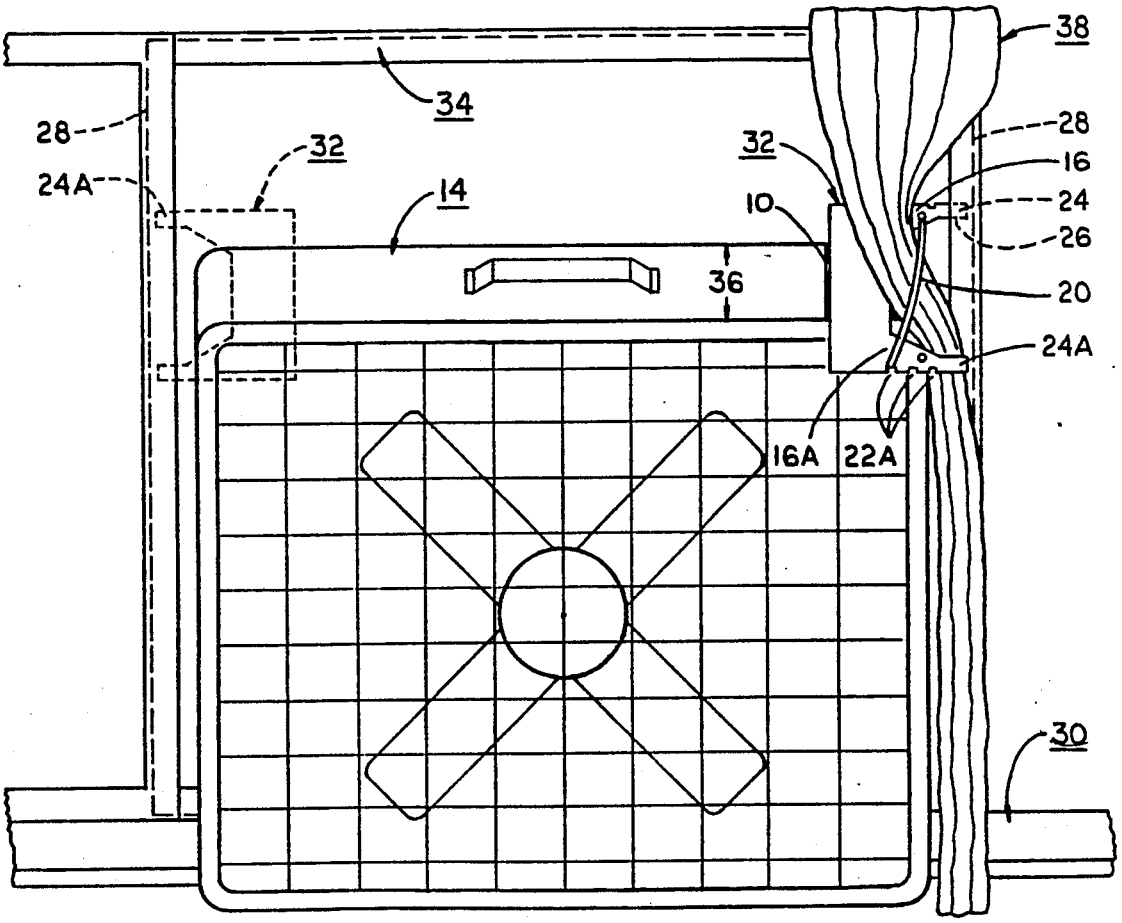

FIG. 3 shows a box fan sitting on a windowsill, while being supported by a window frame adapter assembly. The window curtain is being retained out of the fans air intake by the secondary protruding arm. An elastic band is tying the curtain to the adapter.

REFERENCE NUMERALS IN DRAWINGS

10: adhesive backed hook and loop fastener (hook half)
10A: adhesive backed hook and loop fastener (loop half)
12: base member
14: box fan
16: protruding arm
16A: secondary protruding arm
18: opening
18A: secondary opening
20: elastic band
20A: secondary elastic band
22: notches
22A: secondary notches
24: contact finger
24A: secondary contact finger
26: contact face
26A: secondary contact face
28: window frame track or groove
30: windowsill
32: window frame adapter assembly
34: window frame
36: adapter adjustment directions
38: window curtain

DESCRIPTION OF THE PREFERRED EMBODIMENT—FIGS. 1 TO 3

Figure 1:
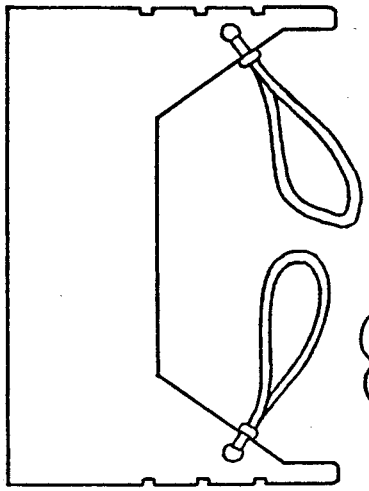
FIG. 1 shows the top view of the window frame adapter with elastic bands attached. This view helps to aid dimensional clarity.
Figure 2:
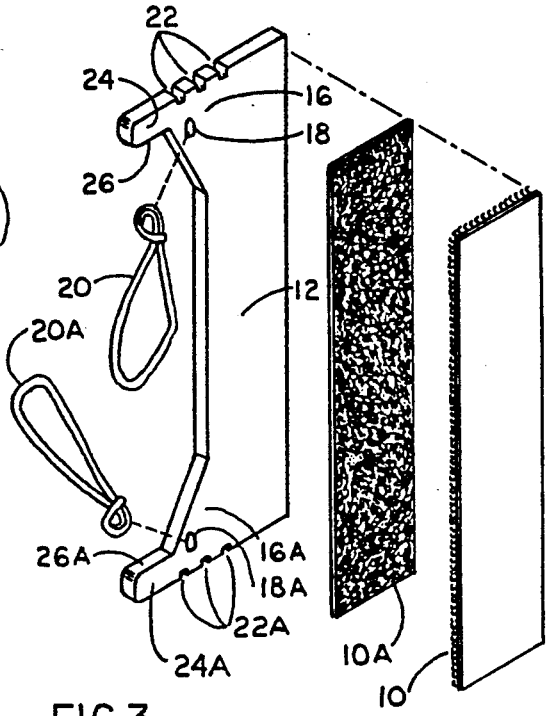
FIG. 2 shows an exploded isometric view of the window frame adapter.

A typical embodiment of the window frame adapter of the present invention is illustrated in FIG. 1 (top view) (shown to aid dimensional clarity) and FIG. 2 (exploded isometric view).

The adapter (FIG. 2) comprises an adhesive backed hook and loop fastener (hook half) 10 which is applied to a box fan 14 (FIG. 3) directly on one corner of its top. FIG. 2 shows an adhesive backed hook and loop fastener (loop half) 10A which is applied to a base member 12.

Base member 12 can be made of any flat rigid material, but plastic is most practical. The plastic required is inexpensive and easy to form. Many types of fasteners can be used on base member 12, but most have certain drawbacks. E.G.: sheet metal screws would require drilling the fan enclosure and would not allow convenient adjustment. Screw studs used with wing nuts would require a two piece window frame adapter. This would not be economical. Double sided, adhesive backed foam tape would be economical and sturdy, but non-adjustable. Metal or plastic, two piece snaps would be sturdy and adjustable if properly spaced. However, snaps would be difficult to attach to the fan or adapter surfaces and therefore expensive and impractical. Hook and loop fasteners allow adapter removal, reversal, and infinite adjustment to accommodate any window and box fan combination. The pressure sensitive adhesive used on the hook and loop material is convenient and plenty strong for this application.

Base member 12 and hook and loop fasteners 10 and 10A each measure approximately 165 mm×50 mm×5 mm. The large fasteners 10 and 10A mounted directly between base member 12 and a fan enclosure prevent rotational movement of the adapter during use.

A protruding arm 16 extends about 70 mm from one end of base member 12 and is tapered to improve strength and rigidity. Protruding arm 16 has an opening 18 of about 6 mm diameter. An elastic band 20 (common #33 rubber band) is inserted through opening 18, looped over itself and stretched tight, thereby being affixed to arm 16. Arm 16 has three notches 22 which are each approximately 2.5 mm wide and 3.2 mm deep. A contact finger 24 of protruding arm 16 is sized to fit in the most narrow window frame track 28 (FIG. 3), but will also fit behind the window itself. Contact finger 24 measures approximately 22 mm×8 mm×5 mm. Contact finger 24 has a contact face 26 that is rounded. Contact face 26 measures approximately 22 mm×5 mm and has a 16 mm radius. A secondary protruding arm 16A extends from the opposite end of base member 12. Secondary arm 16A includes a secondary opening 18A, a secondary elastic band 20A, secondary notches 22A, a secondary contact finger 24A and a secondary contact face 26A. Protruding arms 16 and 16A and contact fingers 24 and 24A can be made of any rigid material, but plastic is most practical. Plastic construction allows the entire adapter to be injection molded as one unit, except for fasteners 10, 10A and elastic bands 20 and 20A.

OPERATION—FIG. 3

Box fan 14 is shown sitting on a windowsill 30, while being supported by a window frame adapter assembly 32. Hook and loop fastener (loop half) 10A with base member 12 is firmly pressed on to hook and loop fastener (hook half) 10 of box fan 14. The window is opened to expose frame track 28. Contact finger 24 is inserted into frame track 28 on the right side of a window frame 34. Windowsill 30 is not deep enough (front to back) to support box fan 14 on the side opposite window frame 34. This results in box fan 14 trying to tip outward from window frame 34. Contact face 26 of contact finger 24 is therefore being pulled against the inside of frame track 28. Box fan 14 is thereby attached to window frame 34 and cannot tip outward. The rounded surface of contact face 26 helps prevent marking of frame track 28. A soft covering such as thin rubber tubing would serve the same purpose.

Adapter assembly 32 can be adjusted in either direction 36 as indicated, to hold box fan 14 vertically in any window. Box fan 14 can be removed from windowsill 30 with only one hand and with adapter assembly 32 attached by pulling out the side opposite adapter 32 first. Box fan 14 can be installed likewise by putting the adpater 32 side in first. This convenient use is possible because adapter 32 is positioned on only one side of box fan 14 and window frame 34, and because contact finger 24 is continuously movable, being held in place by gravity acting on box fan 14.

A window curtain 38, is of the type used with common "horizontal" sliding windows (separate left and right frame and curtain halves). Curtain 38 is shown in the open position. Curtain 38 is bunched together and placed between protruding arms 16 and 16A. This retains curtain 38 to one side of box fan 14 where it cannot be drawn into the air intake. Elastic band 20 of arm 16 is stretched around curtain 38 and hooked over secondary arm 16A at one of secondary notches 22A. Elastic band 20 ties curtain 38 to adapter 32 for extra security.

When box fan 14 is rotated 180° to blow in the opposite direction, adapter assembly 32 is on the left side of window frame 34 as shown by phantom lines. Secondary contact finger 24A is inserted into frame track 28 on the left side of frame 34 as shown.

Box fans usually have four short, hard plastic feet. Only two of these feet make contact on narrow windowsills. This works fine with the adapter on most sills. Tall, soft polyurethane feet will be included with the adapter. These anti-skid feet are adhesive backed and inexpensive. They will insure box fan stability even on unusually slick or slanted sills. They will prevent scratching of painted sills and provide clearance for the electrical cord when needed.

It will be apparent to those skilled in the art that the foregoing disclosure has solved the major problems and limitations inherent in all large "window fans," box fan adapters or mounting apparatus disclosed heretofore.

The preceding detailed description has shown only one versatile, simple and low cost embodiment thereof. Many other variations are possible. For example: Another embodiment could use a moveable base member such as a bar or rod with protruding arms that contain the window frame hooks or fingers. This base member could move inside a slot or guide hole through a housing for adjustment. This housing would serve as an adjustable fastening method for the base member. A thumbscrew could be used to lock the base member position within the housing. The housing itself could be attached to the fan enclosure with any adhesive, rivets or screws.

Another embodiment could also use two adapter halves. The first half could be permanently attached to the box fan enclosure with any adhesive or strong double faced mounting tape or any of the materials already discussed. This half could contain a set of protruding dowel pins. It would function similar to hook and loop half 10. The second half could contain a base member having protruding arms that contain the window frame hooks or contact fingers. This base member would have corresponding holes for the dowel pins from the first half. It would function similar to hook and loop half 10A. This second half could then be adjusted in position so long as it covered enough dowel pins to support it. Protruding studs or pins built into the fan housing itself could also serve as the dowel pins.

A single arm embodiment containing an additional hook and loop strip on the opposite side of the base member would add material cost and require reattachment when the fan is reversed in position. A wide hook and loop strip could be used on the fan top if lateral adjustment is needed. A short (25 mm) contact finger could be added to the base member directly opposite each protruding arm. The adapter could then be turned around for lateral position adjustment.

Any of these examples could have protruding arms containing expanding spring clamps that lock into the window frame track. A clamp that surrounds one lip of the frame track could also be used. None of these variations for attaching the box fan to the window frame are necessary for stable support. Most of these embodiments of the invention would significantly increase its cost and/or make its use less convenient.

These embodiments are not unique or important enough to be shown in separate drawings. Accordingly, the scope of the invention should not be determined by any of the embodiments illustrated or discussed, but by the appended claims and their equivalents.

I claim:

1. An adapter for attachment to a portable box fan for supporting said fan in an operable position on a sill of a window frame wherein said frame includes a track or groove for supporting said fan, said adapter includes:

(a) a base member of flat rigid material, and (b) adjustable fastener means connected directly between said base member and an enclosure of said fan for fastening said base member to said fan enclosure and (c) a protruding arm having one end connected to said base member and an opposite end having attaching means for attachment to said window frame whereby said fan is supported in said operable position wherein said attaching means comprises a contact finger which fits into said track or groove of said window frame, and (d) window curtain retaining means, whereby a window curtain adjacent said window frame is prevented from being drawn into said fan.

2. The adapter of claim 1 wherein said window curtain retaining means is a secondary protruding arm.

3. The adapter of claim 1 wherein said fastener means comprises adhesive backed hook and loop material.

4. The adapter of claim 1 wherein said protruding arm and said curtain retaining means comprises tying means for tying said curtain to said adapter.

5. The adapter of claim 4 wherein said tying means comprises elastic bands.

6. The adapter of claim 4 wherein said protruding arm and said curtain retaining means each include notches for receiving said tying means when said curtain is tied.

* * * * *